United States Patent [19]

Blatt et al.

[11] 4,453,755

[45] Jun. 12, 1984

[54] VACUUM CUP VENTURI ASSEMBLY AND BLOW OFF SILENCER

[75] Inventors: Leland F. Blatt, 31915 Groesbeck Hwy., Fraser, Mich. 48026; John G. Laing, St. Clair Shores, Mich.

[73] Assignee: Leland F. Blatt, Grosse Pointe Shores, Mich.

[21] Appl. No.: 406,071

[22] Filed: Aug. 6, 1982

[51] Int. Cl.[3] ..... B66C 1/02

[52] U.S. Cl. ..... 294/64 A; 417/185

[58] Field of Search ..... 294/64 R, 64 A, 64 B; 137/596.13; 181/237, 268; 269/21; 279/3; 414/627, 744 B, 752; 417/182, 185, 192, 193

[56] References Cited

U.S. PATENT DOCUMENTS

| | | | |
|---|---|---|---|
| 3,052,479 | 9/1962 | La Trell | 417/185 X |
| 3,181,563 | 5/1965 | Giffen | 294/64 R X |
| 3,349,927 | 10/1967 | Blatt | 414/752 X |
| 3,675,733 | 7/1972 | Blatt | 181/237 |
| 4,073,602 | 2/1978 | Cagle | 294/64 A X |

FOREIGN PATENT DOCUMENTS

| | | | |
|---|---|---|---|
| 1506492 | 6/1981 | Fed. Rep. of Germany | 294/64 A |
| 624860 | 9/1978 | U.S.S.R. | 294/64 R |

*Primary Examiner*—Johnny D. Cherry

*Attorney, Agent, or Firm*—Cullen, Sloman, Cantor, Grauer, Scott & Rutherford

[57] ABSTRACT

In a vacuum cup assembly including a body having a vacuum chamber and a vacuum cup communicating with the vacuum chamber for supporting a workpiece, a venturi jet connected to a source of pressurized air and the vacuum chamber and an air outlet, there is provided an air blow-off silencer having an inlet mounted upon the air outlet, an intermediate apertured web and a silencer chamber containing an air silencer assembly. A poppet valve is guidably positioned within the web having an advanced rest position and retractable relative to a pressure chamber in the web to an air blocking position. Application of pressurized air to the pressure chamber moves the poppet valve to close the air outlet of the vacuum cup assembly, the pressurized air to the venturi assembly by-passing to the vacuum chamber to blow off the workpiece.

7 Claims, 3 Drawing Figures

WP

VACUUM CUP VENTURI ASSEMBLY AND BLOW OFF SILENCER

BACKGROUND OF THE INVENTION

Heretofore in accordance with Leland F. Blatt U.S. Pat. No. 3,349,927, dated Oct. 31, 1967, there was provided a vacuum cup assembly having a body and a vacuum chamber in communication with the flexible vacuum cup together with a venturi jet assembly sealed within the body and connected to a source of pressurized air and to the vacuum chamber, and with the venturi jet assembly terminating in an air outlet in said body. Air escaping through the venturi produced a vacuum due to the Bernoulli principle, the vacuum being produced and held as long as the air flow is directed across the venturi for evacuating the vacuum chamber and the workpiece supporting flexible vacuum cup connected thereto. Should the vacuum producing air flow be stopped, a considerable period of time was necessary to allow atmospheric air to leak back through the venturi and pressurize the vacuum chamber in order that the workpiece may be separated from the vacuum cup.

Heretofore in the use of vacuum cup assemblies including the flow of pressurized air through a venturi jet assembly there have been employed air silencers such as disclosed in Leland F. Blatt U.S. Pat. No. 3,675,733 of July 11, 1972 and Leland F. Blatt U.S. Pat. No. 3,675,734 dated July 11, 1972.

The blow-off silencer essentially embodied a pair of hemispherically shaped opposed frequency distorters which modify certain frequency sound levels lowering them to a predetermined noise level for minimizing the noise of the exhausting air from the vacuum cup venturi assembly.

SUMMARY OF THE INVENTION

An important feature of the present invention is to provide within the barrel of an air silencer assembly mounted upon vacuum cup assembly air outlet, a poppet valve movably positioned within an axial chamber within said barrel between an advanced rest position and a retracted air cut-off position wherein the poppet valve operatively engages and closes off the air outlet from the vacuum cup venturi assembly for stopping the venturi action. The pressurized air connected to the venturi jet assembly is thereby by-passed into the vacuum chamber and the workpiece supported by the vacuum within the vacuum cup is blown free.

A further feature incorporates within the silencer barrel within an apertured web therein an axial bore within which a poppet valve is guidably positioned, which is adapted to move from the air flow advanced rest position to a retracted air cut-off position relative to the outlet of the venturi jet assembly by pressurizing a chamber in advance of the poppet valve retracting said poppet valve to a cut-off position blocking the air outlet from the venturi assembly.

As a further feature when the poppet valve pressurizing chamber is exhausted, the pressurized air within the venturi jet assembly will continue to flow past the venturi into the outlet and by venturi action re-establish vacuum within the vacuum chamber, and with the exhausting air escaping through the silencing chamber to atmosphere.

A further feature includes a universal fitting upon the silencer having an air inlet port and an outlet communicating with the poppet pressure chamber, together with a valve assembly connected to a source of pressurized air normally delivering pressurized air to the venturi jet assembly and in a secondary position additionally directing pressurized air through the universal fitting to the poppet pressure chamber. This causes a retraction of the poppet to a cut-off position blocking the outlet from the air jet assembly. This stops venturi action and anything attached to the vacuum chamber connected to the venturi is pressurized and blown free.

A further feature incorporates an improved air silencer assembly reducing the sound level of the escaping air from the vacuum cup jet assembly to a predetermined noise level and at the same time including a pressurizing chamber connected to an air pressure source selectively for retracting the poppet valve to a cut-off position deactivating venturi action pressurizing the vacuum chamber and blowing off the workpiece.

These and other features and objects will be seen from the following specification and claims in conjunction with the appended drawing.

THE DRAWING

Figures 1, 2, 3:
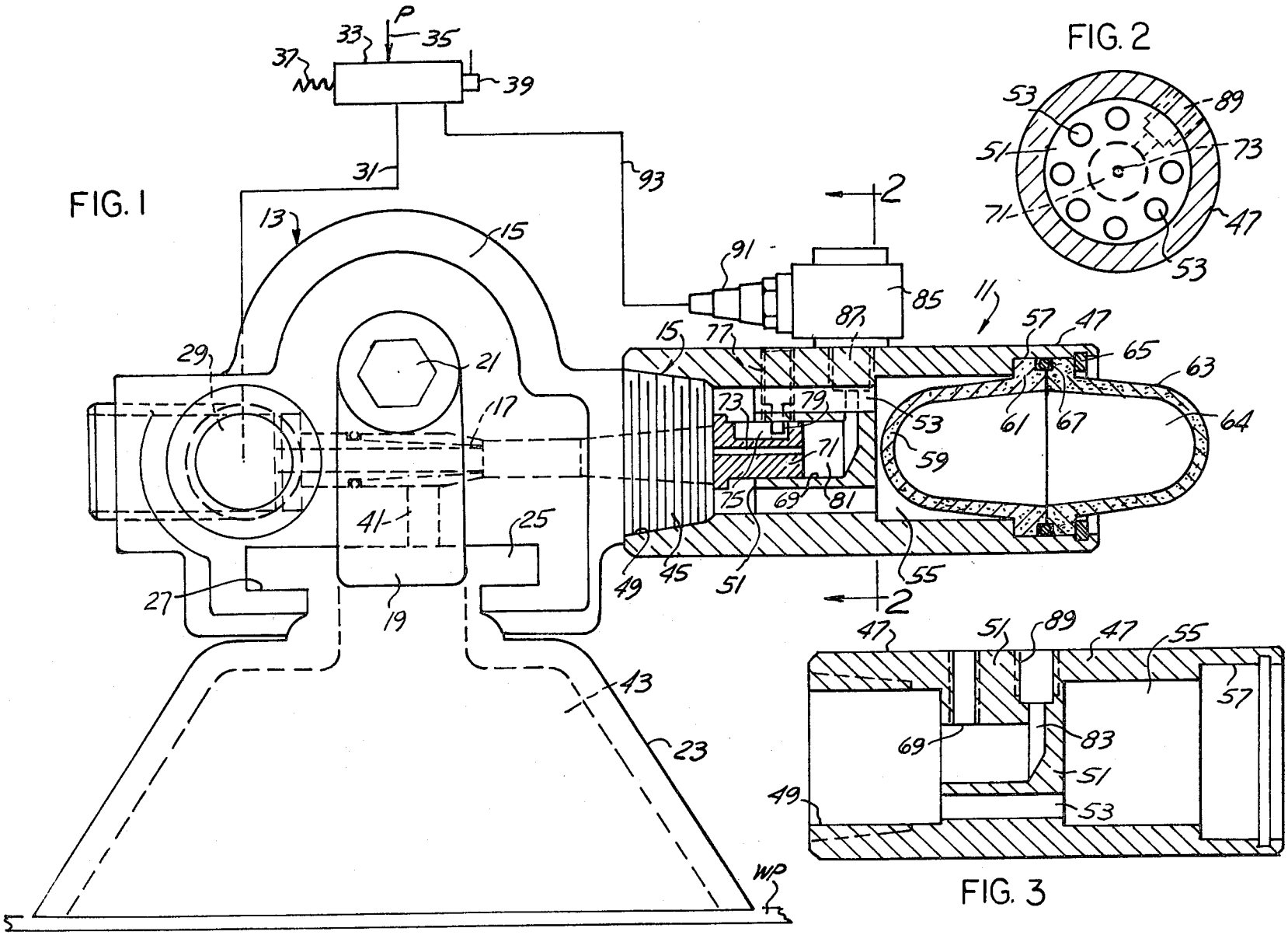
FIG. 1 is a fragmentary longitudinal section of the present venturi and vacuum cup mount assembly and associated blow-off silencer.
FIG. 2 is a section taken in the direction of arrows 2—2 of FIG. 1.
FIG. 3 is a longitudinal section of the silencer barrel.

It will be understood that the above drawing illustrates merely a preferred embodiment of the invention, and that other embodiments are contemplated within the scope of the claims hereinafter set forth.

DETAILED DESCRIPTION OF THE EMBODIMENT OF THE INVENTION

Referring to the drawing the present vacuum cup assembly includes blow-off silencer 11 connected to and mounted upon the venturi and vacuum cup mount 13 as assembled in FIG. 1.

Generally the blow-off silencer embodies a pair of hemispherically shaped frequency distorters 63 of a porous material which modifies certain sound frequency levels, lowering them below a predetermined noise level in order to accomodate the rather noisy exhaust air from the venturi assembly.

The present venturi assembly is disclosed in further detail in the Leland F. Blatt U.S. Pat. No. 3,349,927 whose disclosure is incorporated herein to the extent necessary for a complete understanding of the function and operation of the present venturi assembly 13.

Pressurized air escapes through the venturi 17 for producing a vacuum due to the Bernoulli principle, vacuum being produced in chamber 41 and held as long as air flow is directed across the venturi evacuating the associated vacuum chamber. Heretofore in the use of venturi assemblies of this nature, should the vacuum producing pressurized air flow be stopped, a considerable period of time is necessary to allow atmospheric air pressure to leak back through the venturi to pressurize the vacuum chamber. The specific details of the vacuum silencer as to function and operations are set forth in Leland F. Blatt U.S. Pat. No. 3,675,733 and 3,675,734 both dated July 11, 1972. The disclosures therein to the extent necessary for full understanding of the operation of the silencer are incorporated herein.

The venturi and vacuum cup mount assembly 13 FIG. 1 includes venturi cup mount body 15 mounted on a suitable support and enclosed therein the venturi jet 17.

Retainer plate 19 mounted upon the venturi cup mount body 15 as by cap screw 21 is adapted to retainingly engage the centerally apertured T-flange 25 forming a part of the vacuum cup mount 23, which is slidably mounted upon slotted support 27 cup mount body 15.

A suitable pressurized air inlet on body 15 fitting 29 is in communication with the venturi jet 17 and by suitable conduit 31 FIG. 1 connected to valve assembly 33, in turn connected to a pressurized air source 35.

The valve assembly includes a conventional spring 37 for biasing its valve element in one direction, the valve element being adapted for movement in the opposite direction under the control of solenoid 39 or any suitable equivalent air control to provide a secondary position of adjustment for the movable valve element.

Upstream of the venturi outlet 45 forming a part of the venturi jet assembly 17 there is provided in communication therewith vacuum chamber 41. Said chamber is at all times in communication with chamber 43 within vacuum cup 23, holding work piece W P.

In operation with pressurized air from the source 35 and from the valve 33 passing through conduit 31 and air inlet fitting 29, there is delivered through the venturi jet assembly 17 a continous flow of pressurized air for establishing a vacuum within the vacuum chamber 41 and in the vacuum cup chamber 43 for retaining and supporting the work piece W P, fragmentarily shown.

Forming a part of the venturi cup mount body 15 there is provided venturi air outlet 45 through which exhaust air from the venturi jet assembly passes.

The present air blow-off silencer 11 FIG. 1 includes a cylindrical barrel 47 having at one end an inlet bore 49 which is adapted to cooperatively receive venturi cup mount body outlet 45, upon which the blow-off silencer is mounted and retained.

Intermediate the ends of barrel 47 is a transverse web 51 having formed therethrough a plurality of circularly arranged elongated air passages 53, FIG. 2, which are in communication with air inlet bore 49. Arranged within the barrel 45 upon its other end and adjacent the web 51 is an elongated silencer chamber or bore 55 having a counterbore 57 therein.

A first porous frequency distorter insert 59 of dome shape is mounted within said barrel within silencer chamber 55 having at one end an annular mount flange 61 which is nested within counterbore 57. A second opposed porous frequency distorter insert 63, which may be constructed of a ceramic material, is arranged partly within said barrel with its annular flange 61 in registry with the corresponding mount flange of the first frequency distorter insert 59 and sealed therein by the common O-ring 67. The inserts are secured in position within said barrel by the retaining ring 65 nested within a corresponding undercut annular recess adjacent to the open end of barrel 47. The remainder of the second frequency distorter insert 63 projects axially outward of the end of barrel 47.

Within and projecting into one side of web 51 adjacent inlet bore 49 is an axial bore 69 within which is guidably nested the poppet valve 71. Said valve has a rest position adjacent the forward end of the web 51, and an air cut off retracted position such as shown in FIG. 1.

Axially of the poppet valve and throughout its length is a small hole or central bore 73. Intermediate the ends of the poppet valve 71 exteriorally thereof is an axial slot 75. Poppet retainer screw 77 is threaded radially into the barrel 47 into web 51 and at its inner end has a pin 79 which guidably extends within slot 75 of the poppet valve for limiting movements of the poppet valve to rectilinear movements.

As shown in FIG. 1 outwardly of the poppet valve 71 there is a poppet pressure chamber 81, which through an internal passage 83 within said web communicates with radial bore 89.

The universal fitting 85 has a threated outlet 87 which is projected into the bore 89 and at its opposite end has a hose fitting port 91. Said fitting port is connected by conduit 93 FIG. 1 to an outlet of the valve 33. Depending upon positioning of the valve element within said valve, such as its secondary position, pressurized air is delivered from the source 35 through the conduit 93 to the universal fitting 85 for pressurizing poppet pressure chamber 81.

In the function and operation of the valve 33 with its spring 37 biased valve element in a first position, pressurized air is delivered through conduit 31 for pressurizing the venturi assembly 17.

In a secondary position of the valve element under the action of the solenoid 39 or an air pressure, pressurized air through conduit 31 is not cut off, but additionally pressurized air is delivered through conduit 93 to the universal fitting 85 for pressurizing the poppet pressure chamber 81. This causes a retraction of poppet valve 71 to the position shown in FIG. 1 so as to operatively engage cup mount body outlet 45 closing off the passage of exhaust air therethrough.

With the poppet valve in the cut off position shown, and with the inlet port 91 pressurized, poppet valve 71 is secured against the venturi air passage outlet 45 and all venturi action is stopped. The vacuum chamber 41 is immediately pressurized and the work piece W P blown off of the vacuum cup 23.

To start vacuum flowing again and in communication with the vacuum chamber 41 and the cup chamber 43, the port 91 is exhausted due to a reversal of the valve element within the valve 33. This initiates venturi air exhaust through the outlet 45. The poppet 71 is advanced to its secondary rest position away from the position shown in FIG. 1 under the action of the pressurized air acting against said poppet valve.

Vacuum producing venturi action again takes place with venturi air escaping through the several passages 53 within the barrel directing escaped air into the silencing chamber 55. Here a frequency change of the exhaust air take place through the action of the silencer inserts 59 and 63 reducing the noise level of the exhausting air to a livable level.

The retaining screw pin 79 is adapted to retain the poppet valve 71 within the corresponding bore 69 of the barrel, when the silencer assembly has been disassembled from the cup mount assembly 13.

In order to facilitate work piece blow off there is provided a small axial aperture 73 through the poppet valve 71. At the time that the valve 33 has been adjusted to provide pressurized air through conduit 93 to the poppet pressure chamber 81 the poppet valve moves to air blocking position, shown in FIG. 1. This stops the venturi action. The pressurized air is deflected or bypassed into the vacuum chamber 41 and into the cup chamber 43 for blowing off the workpiece or other part.

The axial passage 73 within the poppet valve 71 provides a means of delivering additional pressurized air through venturi 17 and into the vacuum chamber 41 decreasing vacuum blow off time.

Having described our invention reference should now be had to the following claims.

We claim:

1. In a vacuum cup assembly including a body having a vacuum chamber, a flexible vacuum cup mounted upon said body in communication with said vacuum chamber for supporting a workpiece, a venturi jet assembly sealed within said body connected to a source of pressurized air and to said vacuum chamber, and an air outlet connected to said venturi jet assembly;

a blow-off silencer including a cylindrical barrel having an axial inlet bore at one end receiving and mounted upon said air outlet;

a transverse apertured web in said barrel communicating with said inlet bore, there being a silencer chamber within said barrel at its other end communicating with said inlet bore and outletting to atmosphere;

a porous air silencer assembly within said silencer chamber;

there being an axial bore extending into said web communicating with said inlet bore;

a reciprocal poppet valve guidably nested within said axial bore for movements between an advanced rest position and a retracted air blocking position in registry with and closing said air outlet, and defining with said web a poppet pressure chamber;

an air valve connected to a source of pressurized air and in a first position continuously delivering pressurized air to said venturi jet assembly;

a ported pressure fitting upon said barrel connected to said poppet pressure chamber, said air valve in a second position additionally connected to said pressure fitting for pressurizing said poppet pressure chamber, retracting said poppet valve to its air blocking position;

the pressurized air within said jet assembly being by-passed through said vacuum chamber for blowing off the workpiece from said vacuum cup.

2. In the vacuum cup assembly of claim 1, said air valve when returned to its first position venting said poppet valve pressure chamber, the pressurized air to said venturi jet assembly passing through said air outlet advancing said poppet valve to its rest position and depressurizing said vacuum chamber.

3. In the vacuum cup assembly of claim 1, guide means between said barrel and poppet valve limiting its movement to rectilinear movements and limiting retracting movement of said poppet valve relative to said web.

4. The vacuum cup assembly of claim 3, said guide means including a screw pin radially threaded into said barrel and into a corresponding slot within said poppet valve.

5. In the vacuum cup assembly of claim 1, there being an axial passage through said poppet valve for bleeding pressurized air from the poppet valve pressure chamber into said air outlet and vacuum chamber for facilitating workpiece blow-off.

6. In the vacuum cup assembly of claim 1, the air silencer assembly including a pair of opposed dome-shaped inserts of porous material nested and retained within said silencer chamber, through which exhaust air from said air jet assembly passes, said inserts destroying, modifying and reducing the frequency of the exhaust air lowering it to a predetermined noise level.

7. In the vacuum cup assembly of claim 1, said apertured web including a series of parallel spaced axial passages extending through said web through 360°, interconnecting said inlet bore and silencer chamber.

* * * * *